US012075852B2

(12) United States Patent
Morgan

(10) Patent No.: US 12,075,852 B2
(45) Date of Patent: Sep. 3, 2024

(54) BREAST-SUPPORTING STRUCTURE

(71) Applicant: NIKE, Inc., Beaverton, OR (US)

(72) Inventor: Daniel P. Morgan, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 81 days.

(21) Appl. No.: 17/893,848

(22) Filed: Aug. 23, 2022

(65) Prior Publication Data

US 2023/0065323 A1 Mar. 2, 2023

Related U.S. Application Data

(60) Provisional application No. 63/236,314, filed on Aug. 24, 2021.

(51) Int. Cl.
*A41C 3/00* (2006.01)

(52) U.S. Cl.
CPC ..... *A41C 3/0028* (2013.01)

(58) Field of Classification Search
CPC ..... A41C 3/0021; A41C 3/0028; A41C 3/12
USPC ..... 450/86
See application file for complete search history.

(56) References Cited

U.S. PATENT DOCUMENTS 2,469,654 A 5/1949 Gerda
2,484,440 A 10/1949 Max
2,983,274 A 5/1961 Plehn
3,411,508 A * 11/1968 Sayers ..... A41C 3/0078 450/86
3,908,670 A * 9/1975 Dubin ..... A41C 3/0021 450/58
4,254,777 A 3/1981 Johnston
D301,932 S 7/1989 Guss
(Continued)

FOREIGN PATENT DOCUMENTS

KR 20-0387854 Y1 6/2005
WO 2014/207379 A1 12/2014
(Continued)

OTHER PUBLICATIONS

International Search Report and Written Opinion received for PCT Patent Application No. PCT/US2022/041359, mailed on Nov. 28, 2022, 12 pages.
(Continued)

*Primary Examiner* — Gloria M Hale
(74) *Attorney, Agent, or Firm* — Shook, Hardy & Bacon L.L.P.

(57) ABSTRACT

Aspects herein are directed to a breast-supporting structure that provides adjustable fit and support to a wearer's breasts. The breast-supporting structure includes an adjustment mechanism that is slidably coupled to a shoulder strap of the bra. A first end and a second end of a continuous cable structure are fixedly secured to the adjustment mechanism. An intervening portion of the continuous cable structure repeatedly extends between the adjustment mechanism and a plurality of spaced-apart pulley structures located at a lower portion of the breast-supporting structure to form a plurality of spaced-apart cable segments. The cable segments slidably engage with both the adjustment mechanism and the pulley structures such that the cable segments are freely movable with respect to the adjustment mechanism and the pulley structures.

17 Claims, 7 Drawing Sheets

(56) References Cited

U.S. PATENT DOCUMENTS

| | | | | |
|---|---|---|---|---|
| D321,083 | S | 10/1991 | Thygesen | |
| 6,896,581 | B2 * | 5/2005 | Otto | A41C 5/00 450/59 |
| 7,089,597 | B2 | 8/2006 | Horii et al. | |
| 7,267,599 | B2 | 9/2007 | Allen et al. | |
| D584,879 | S | 1/2009 | Venus | |
| 7,833,082 | B2 | 11/2010 | Bugada | |
| D671,297 | S | 11/2012 | Tamartino | |
| 8,549,763 | B2 | 10/2013 | Krawchuk | |
| 9,516,905 | B2 | 12/2016 | Pagnon | |
| 9,750,288 | B2 * | 9/2017 | Gehlhausen | A41C 1/06 |
| D816,942 | S | 5/2018 | Holmes | |
| 10,368,591 | B2 | 8/2019 | Funk-Danielson et al. | |
| 10,448,679 | B1 | 10/2019 | Roddis et al. | |
| 10,609,966 | B2 | 4/2020 | Huffa et al. | |
| 2005/0060792 | A1 | 3/2005 | Desai | |
| 2015/0087204 | A1 * | 3/2015 | Conde | A41C 3/142 450/93 |
| 2016/0360801 | A1 | 12/2016 | Sze et al. | |
| 2019/0045853 | A1 * | 2/2019 | Mizoguchi | A41C 3/0021 |
| 2019/0116891 | A1 * | 4/2019 | Wisniewski | A41C 3/0092 |
| 2020/0323279 | A1 * | 10/2020 | Castillo Piedra | A41C 3/0057 |
| 2020/0375269 | A1 | 12/2020 | Andon et al. | |
| 2022/0304394 | A1 * | 9/2022 | Castillo Piedra | A41C 3/0021 |
| 2022/0361594 | A1 | 11/2022 | Morgan | |

FOREIGN PATENT DOCUMENTS

| | | | |
|---|---|---|---|
| WO | 2016/059578 | A1 | 4/2016 |
| WO | 2016/135673 | A1 | 9/2016 |
| WO | 2019/169276 | A1 | 9/2019 |

OTHER PUBLICATIONS

Non-Final Office Action received for U.S. Appl. No. 17/703,208, mailed on Oct. 26, 2023, 11 pages.

International Search Report and Written Opinion received for PCT Patent Application No. PCT/US2022/022454, mailed on Aug. 5, 2022, 12 pages.

Mesh Sports Bra, Sadoun, Available online at: <https://www.sadoun.com/product/mesh-sports-bra-hollow-out-sport-top-seamless-fitness-yoga-bras-women-gym-top-padded-running-vest-shockproof-push-up-crop-top/>, Sep. 26, 2020, 12 pages.

Ocamo Elastic Rope Bra Straps, Amazon, Available online at: <https://www.amazon.in/Ocamo-Elastic-Artemis-Harness-Bondage/dp/B07H93JSQL>, Sep. 12, 2018, 4 pages.

* cited by examiner

BREAST-SUPPORTING STRUCTURE

CROSS-REFERENCE TO RELATED APPLICATIONS

This application claims the benefit of priority of U.S. App. No. 63/236,314 (filed Aug. 24, 2021). The entirety of the aforementioned application is incorporated by reference herein.

TECHNICAL FIELD

Aspects herein are directed to a breast-supporting structure having a cable structure that extends over a wearer's breast and provides adjustable fit and adjustable support.

BACKGROUND

Traditional bras generally utilize static support systems, such as underwires, that provide a fixed level of support to the wearer's breasts. Moreover, the fit of traditional bras generally does not change and is not responsive to, for example, changes in breast morphology that may occur through, for example, exercise or movement. The fit of these bras also often fails to take into account differences in breast shape between a wearer's right breast and a wearer's left breast and/or between breast shapes of different users.

SUMMARY

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are examples and are not limiting.

Clause 1. A breast-supporting structure comprising: an upper portion and a lower portion that is spaced apart from the upper portion; an adjustment mechanism slidably coupled to the upper portion of the breast-supporting structure; and a continuous cable structure having a first end, a second end, and an intervening portion extending between the first end and the second end, each of the first end and the second end fixedly secured to the adjustment mechanism or the lower portion, wherein the intervening portion repeatedly extends between the adjustment mechanism and the lower portion of the breast-supporting structure to form a plurality of spaced-apart cable segments.

Clause 2. The breast-supporting structure according to clause 1, wherein the plurality of cable segments include a central set of cable segments that extend over at least a central region of a wearer's breast.

Clause 3. The breast-supporting structure according to any of clauses 1 through 2, wherein the plurality of cable segments include a medial set of cable segments that extend over a medial region of a wearer's breast and a lateral set of cable segments that extend over a later region of the wearer's breast.

Clause 4. The breast-supporting structure according to any of clauses 1 through 3, wherein the continuous cable structure comprises a low stretch or no-stretch material.

Clause 5. The breast-supporting structure according to any of clauses 1 through 4, wherein one or more of the adjustment mechanism and the lower portion includes a plurality of spaced-apart pulley structures.

Clause 6. The breast-supporting structure according to clause 5, wherein: the intervening portion of the continuous cable structure slidably engages with each of the plurality of spaced-apart pulley structures; and movement of the adjustment mechanism causes at least a portion of the plurality of cable segments to slidably adjust from a first level of tension to a second level of tension.

Clause 7. The breast-supporting structure according to any of clauses 1 through 6, wherein the intervening portion of the continuous cable structure slidably engages with the adjustment mechanism.

Clause 8. A support garment comprising: a front portion formed from a first breast-supporting structure and a second breast-supporting structure; a back portion; a first shoulder strap extending between the first breast-supporting structure and the back portion, the first shoulder strap including a first adjustment mechanism that is slidably coupled to the first shoulder strap; an underband comprising a lower margin of the front portion; and a first continuous cable structure having a first end, a second end, and an intervening portion extending between the first end and the second end, each of the first end and the second end fixedly secured to the first adjustment mechanism or the underband, wherein the intervening portion repeatedly extends between the first adjustment mechanism and the underband to form a first plurality of cable segments.

Clause 9. The support garment according to clause 8 further comprising: a second shoulder strap extending between the second breast-supporting structure and the back portion, the second shoulder strap including a second adjustment mechanism that is slidably coupled to the second shoulder strap; and a second continuous cable structure having a first end, a second end, and an intervening portion extending between the first end and the second end, each of the first end and the second end fixedly secured to the second adjustment mechanism or the underband, wherein the intervening portion repeatedly extends between the second adjustment mechanism and the underband to form a second plurality of spaced-apart cable segments.

Clause 10. The support garment according to clause 9, wherein movement of the first adjustment mechanism causes at least a portion of the first plurality of cable segments to slidably adjust from a first level of tension to a second level of tension; and movement of the second adjustment mechanism causes at least a portion of the second plurality of cable segments to slidably adjust from a third level of tension to a fourth level of tension.

Clause 11. The support garment according to any of clauses 8 to 10, wherein a first set of cable segments of the first plurality of cable segments has a different length than a second set of cable segments of the first plurality of cable segments.

Clause 12. The support garment according to any of clauses 8 through 11, wherein a total length of the first continuous cable structure is dependent upon a cup size of the first breast-supporting structure.

Clause 13. The support garment according to any of clauses 8 through 12, wherein the first continuous cable structure comprises a low stretch or no-stretch material.

Clause 14. The support garment according to any of clauses 8 through 13, wherein one or more of the first adjustment mechanism and the underband includes a plurality of spaced-apart pulley structures.

Clause 15. The support garment according to clause 14, wherein the intervening portion of the first continuous cable structure slidably engages with at least a portion of the plurality of spaced-apart pulley structures.

Clause 16. The support garment according to any of clauses 8 through 15, wherein the intervening portion of the first continuous cable structure slidably engages with the first adjustment mechanism.

Clause 17. A method of manufacturing a breast-supporting structure, the method comprising: slidably coupling an adjustment mechanism to an upper portion of the breast-supporting structure; fixedly securing a first end and a second end of a continuous cable structure to the adjustment mechanism or to a lower portion of the breast-supporting structure; and repeatedly extending an intervening portion of the continuous cable structure between the adjustment mechanism and the lower portion of the breast-supporting structure to form a plurality of spaced-apart cable segments.

Clause 18. The method of manufacturing the breast-supporting structure according to clause 17, further comprising incorporating the breast-supporting structure into a support garment.

Clause 19. The method of manufacturing the breast-supporting structure according to clause 18, wherein the support garment is a bra.

Clause 20. The method of manufacturing the breast-supporting structure according to clause 19, wherein the lower portion of the breast-supporting structure is an underband configured to encircle a torso area of a wearer.

Clause 21: The support garment according to any of clauses 8 to 16, wherein the first plurality of cable segments comprises a shape configuration.

Clause 22: The support garment according to clause 21, wherein the shape configuration includes a first portion closer to the first adjustment mechanism and a second portion closer to the underband, the second portion having a larger size than the first portion.

Clause 23: The support garment according to clause 21 or 22, wherein, when the support garment is worn, the shape configuration corresponds to a breast morphology associated with a wearer.

Clause 24: The support garment of any of clauses 21 to 23, wherein: the second plurality of cable segments comprises a second shape configuration, which is substantially the same as the shape configuration of the first plurality of cable segments.

BRIEF DESCRIPTION OF THE DRAWINGS

Examples of aspects herein are described in detail below with reference to the attached drawing figures, wherein.

DETAILED DESCRIPTION

Figure 1:
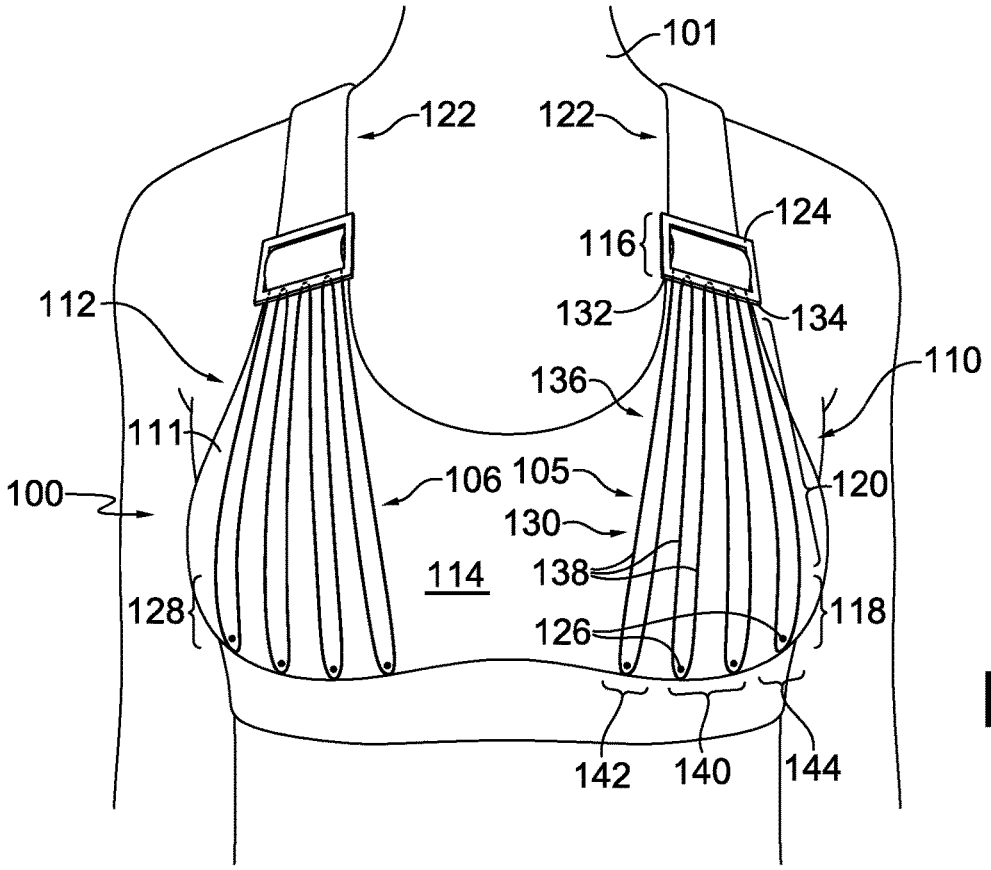
FIG. 1 illustrates a front view of an example support garment having first and second breast-supporting structures in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

Traditional bras generally utilize static support systems, such as underwires, that provide a fixed level of support to the wearer's breasts. Moreover, the fit of traditional bras generally does not change and is not responsive to, for example, changes in breast morphology that may occur through, for example, exercise or movement. The fit of these bras also often fails to take into account differences in breast shape between a wearer's right breast and a wearer's left breast and/or between breast shapes of different users that wear a particular cup size.

Aspects herein are directed to a breast-supporting structure that provides adjustable and dynamic fit and adjustable support including dynamic support to a wearer's breasts. The breast-supporting structure is adapted to be positioned over a wearer's breast when incorporated into a support garment such as a bra. In example aspects, the breast-supporting structure includes an adjustment mechanism that is slidably coupled to, for example, a shoulder strap of the bra. The breast-supporting structure further includes a continuous cable structure formed of a low or no-stretch material and having a first end, a second end, and an intervening portion extending between the first end and the second end. In example aspects, the first end and the second end of the continuous cable structure are fixedly secured to the adjustment mechanism. The intervening portion of the continuous cable structure repeatedly extends between the adjustment mechanism and a plurality of spaced-apart pulley structures located at a lower portion of the breast-supporting structure and/or at the adjustment mechanism to form a plurality of spaced-apart cable segments. The cable segments extend over, for example, medial, central, and lateral areas of a wearer's breast when the bra is in an as-worn configuration. In example aspects, the cable segments formed by the intervening portion of the continuous cable structure slidably engage with both the adjustment mechanism and the pulley structures such that the cable segments are freely movable with respect to the adjustment mechanism and the pulley structures.

To increase or decrease the overall level of support provided by the breast-supporting structure, the adjustment mechanism can be moved from a first position to a second position which causes the cable segments to slidably adjust from a first level of tension to a second level of tension. For example, when the adjustment mechanism is located closer to an apex of a breast-covering portion of the bra, the cable segments may have a first level of tension or be in a relatively slack state. When the adjustment mechanism is slid upward along the shoulder strap, the cable segments self-adjust to a second level of tension greater than the first level of tension so that the cable segments are generally more taut and provide a greater level of support (as compared to before the adjustment mechanism is slid upward along the shoulder strap). In example aspects, because the cable segments slidably engage with the adjustment mechanism and with the pulley structures, each of the cable segments self-adjust to have approximately the same level of tension. That is, as the overall tension associated with the overall cable system increases, the system can evenly distribute the increased tension among the cable segments.

The configuration of the breast-supporting structure as described above, including the slidable engagement of the cable structure with both the adjustment mechanism and the pulley structures, further enables dynamic fit and support adjustment based on breast morphology and/or breast movement. In example aspects, this may occur without a wearer moving the adjustment mechanism along the shoulder strap. For example, wearers that share the same bra cup size may have different breast morphologies. For breasts that have a relatively globular morphology, the cable segments self-adjust in length such that cable segments located over the central region of the wearer's breast may have a longer length than cable segments located over the medial and lateral regions of the wearer's breasts to provide a consistent level of support across the wearer's breasts. For breasts that have a relatively wide, less globular morphology, the cable segments self-adjust in length such that the cable segments generally have lengths that are more consistent (as compared to a globular morphology in which lengths can vary) while providing a consistent level of support across medial, central, and lateral regions of the wearer's breasts. With respect to breast movement, such as when a wearer is laying on her side or when the breasts undergo an up-and-down and/or side-to-side motion due to, for example, running or other movements (e.g., yoga movements), the cable segments may self-adjust in length to provide a uniform level of support and fit regardless of breast position.

As used throughout this disclosure, the term "support garment" is meant to encompass any type of garment configured to support a wearer's breasts. As such, the term support garment encompasses traditional bras, sport bras, tanks, camisoles, swim tops, and the like. The term "breast-covering portion" means the portion of the support garment configured to cover a wearer's breast. As such, the breast-covering portion generally extends from a top part (e.g., near the wearer's clavicle) to a lower part (e.g., the wearer's inframammary fold) of each of the wearer's breasts and from a medial edge (e.g., near the wearer's sternum) to a lateral edge (e.g., near the wearer's axilla) of each of the wearer's breasts. The term "apex portion" when referring to the support garment means the uppermost part of the breast-covering portion and may further represent the area where a shoulder strap extends from or is joined to the breast-covering portion. The term "underband" when used in relation to, for instance, a bra refers to the portion of the bra that forms a lower margin of at least the front portion of the bra. The underband is configured to encircle the torso area of a wearer and may include a separate pattern piece or may include an integral extension of the front portion. The breast-supporting structures described herein are configured to be positioned adjacent to and/or extend over a wearer's breasts and generally extend from a top part (e.g., near the wearer's clavicle) to a lower part (e.g., the wearer's inframammary fold) of each of the wearer's breasts and from a medial edge (e.g., near the wearer's sternum) to a lateral edge (e.g., near the wearer's axilla) of each of the wearer's breasts.

Positional terms when used to describe the breast-supporting structure such as "medial," "lateral," "central," "upper," "lower," and the like are with respect to the breast-supporting structure being worn as intended by a wearer standing upright. As such, the term upper means located closer to a head of a wearer, and the term lower means located closer to the waist of a wearer. The term medial when used in relation to a breast-supporting structure means located closer to a midline of a wearer's body, and the term lateral when used in relation to the breast-supporting structure means located closer to a mid-axillary line of the wearer. The term "central" when used in relation to the breast-supporting structure means located approximately midway between the medial and the lateral sides of the breast-supporting structure. This location corresponds generally to the central vertical part of the wearer's breast which encompasses the areola and the areas of the breast above the areola up to near the wearer's clavicle, below the areola down to near or including the inframammary fold, and areas positioned to the medial and lateral sides of the areola (e.g., within about 2 to 4 cm of the areola).

The term "cable structure," means a structure having a length and a width where the length is greater than the width. For example, the length may be at least about 25 times greater than the width. For example, if an individual cable structure has a width of 5 mm, it has a length of at least about 125 mm or 12.5 cm. The term "continuous" when used to describe the cable structure means a cable structure having a continuous length without interruption or breaks. The term "cable segment" refers to a portion of the continuous cable structure where a particular cable segment has a length as measured from a bottom edge of the adjustment mechanism to its corresponding pulley structure.

As described herein, the cable structure is formed from a low- or no-stretch material (e.g., nylon, polyester, Kevlar® yarn or cable, carbon-fiber yarn or cable, etc.) meaning that the material generally does not have inherent stretch properties (mechanical or elastic) in response to a tensioning force and thus the length and/or width of the material remains substantially unchanged when subject to the tensioning forces below the material's breaking/tearing point. For example, the cable structure may undergo a change of length from about 0% of resting length to about 20% of resting length in response to a tensioning force. Aspects herein further contemplate that the cable structure have a tensile strength and tenacity sufficient to support around, for example, three pounds or more which represents an average weight of a D-cup size breast. One example testing standard for determining the tensile properties of yarns includes ASTM D2256/D2256M (2015). The cable structure may be formed of a material that has a low coefficient of friction such that the cable structure slides easily relative to the adjustment mechanism and the pulley structures. An example cable structure may be formed of a thermoplastic polyurethane (TPU) coated yarn strand comprising para-aramid fiber. A diameter of an example cable structure may be from about 0.05 cm to about 1 cm, or from about 0.01 cm to about 0.2 cm.

The term pulley structure as used herein means a structure that acts to change the direction of a force applied to the cable structure. The term "tension" when referring to the cable structure means a pulling force that is transmitted axially along the length of the cable structure. In example aspects, the amount or level of tension of, for example, a cable segment may be measured using a dynamometer or a tension meter, utilizing a stretch sensor, and/or calculating the tension using the formula: (breast mass×breast acceleration)/number of cable segments. The term "dynamic" as used herein with reference to dynamic fit and/or dynamic support means that the change in fit or support occurs without human intervention (i.e., the fit and/or support self-adjusts).

Unless indicated otherwise, all measurements provided herein are taken when the breast-supporting structure is at standard ambient temperature and pressure (298.15 K and 100 kPa).

FIG. 1 depicts a front view of a wearer 101 wearing a support garment 100 in the form of a bra that includes a first breast-supporting structure 110 that covers a left breast of the wearer 101 and a second breast-supporting structure 112 that covers a right breast of the wearer 101 where each of the first and second breast-supporting structures 110 and 112 include the same shape configuration (i.e., same configuration of cable segments). It is contemplated herein that the first and second breast-supporting structures 110 and 112 may each have a different configuration of cable segments. The first and second breast-supporting structures 110 and 112 form, at least in part, a front portion 111 of the support garment 100. In example aspects, and as shown in FIG. 1, the first and second breast-supporting structures 110 and 112 may be positioned external to a base layer 114 that forms, in combination with at least the first and second breast-supporting structures 110 and 112, the support garment 100. The base layer 114 forms a first breast-covering portion 105 configured to cover the left breast of the wearer 101 and a second breast-covering portion 106 configured to cover the right breast of the wearer 101. The base layer 114 may include a textile (knit, woven, nonwoven) that may have elastic properties to provide additional support to the wearer's breasts. Although the first and second breast-supporting structures 110 and 112 are shown positioned external to the base layer 114, it is contemplated herein that the first and second breast-supporting structures 110 and 112 may be positioned internal to the base layer 114 or may be positioned between two or more layers (e.g., between an inner or base layer and an outer layer). The discussion that follows is with respect to the first breast-supporting structure 110 but is equally applicable to the second breast-supporting structure 112.

Figure 6A:
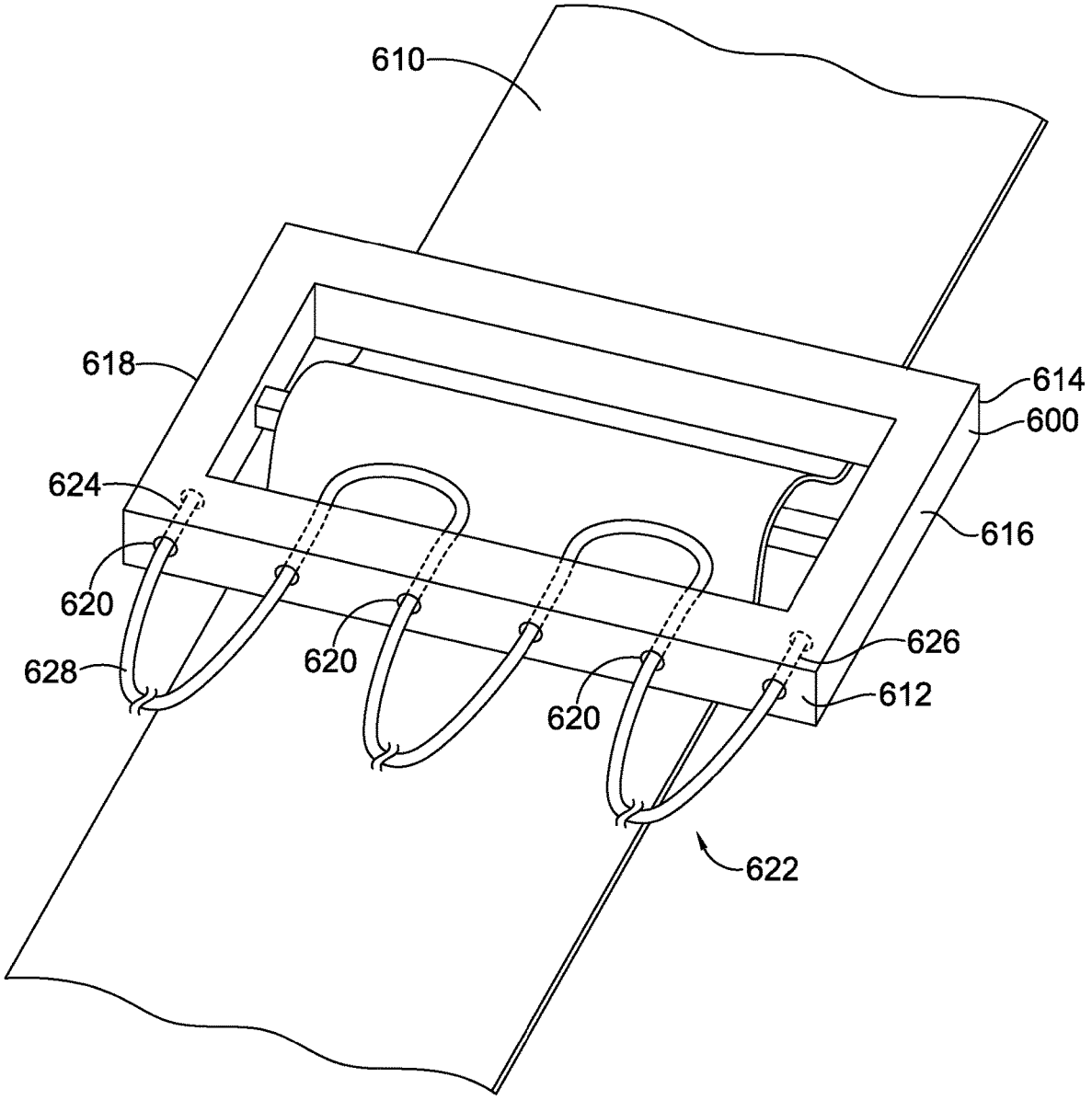
FIG. 6A illustrates an example adjustment mechanism in accordance with aspects herein.
Figure 6B:
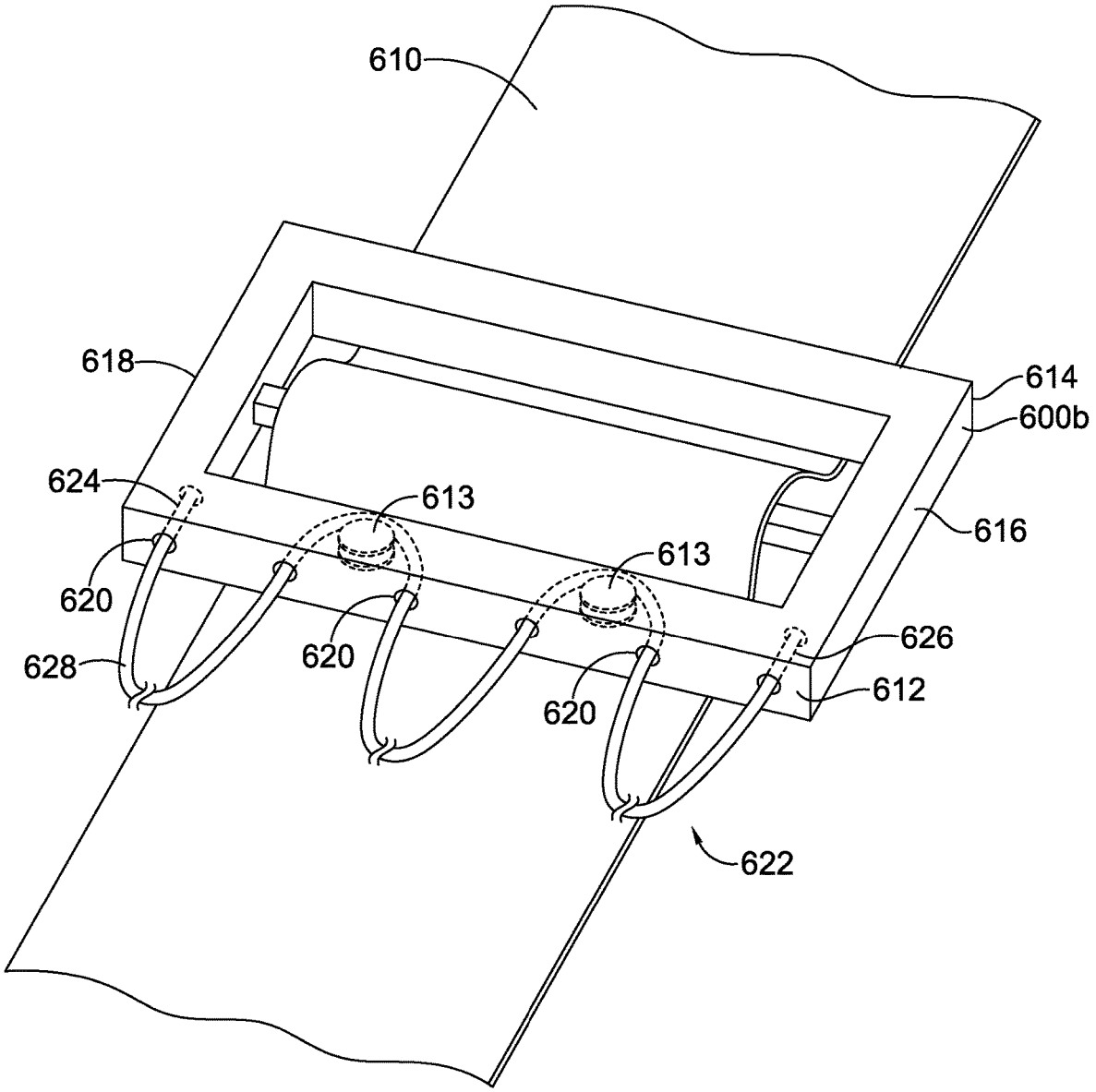
FIG. 6B includes another depiction of an example adjustment mechanism in accordance with aspects here.

The first breast-supporting structure 110 includes an upper portion 116 and a lower portion 118 where the lower portion 118 is spaced apart from the upper portion 116 by a middle portion 120. In example aspects, the upper portion 116 of the first breast-supporting structure 110 may include a shoulder strap 122 where the shoulder strap 122 is adapted to extend over a shoulder area of the wearer 101. The first breast-supporting structure 110 includes a first adjustment mechanism 124 that is slidably coupled to the shoulder strap 122. In example aspects, the first adjustment mechanism 124 may be in the form of a slide buckle although other structures capable of sliding along a length of the shoulder strap 122 are contemplated herein. Examples of an adjustment mechanism are described in relation to FIGS. 6A and 6B. The first breast-supporting structure 110 further includes a plurality of spaced-apart pulley structures 126 positioned at the lower portion 118 of the first breast-supporting structure 110. In example aspects, the pulley structures 126 are positioned at an underband area 128 of the support garment 100 and are generally horizontally aligned and parallel to a lower margin of the support garment 100. Some example pulley structures will be described in relation to FIGS. 7-8.

The first breast-supporting structure 110 additionally includes a continuous cable structure 130 having a first end 132 fixedly secured to the first adjustment mechanism 124, a second end 134 fixedly secured to the first adjustment mechanism 124, and an intervening portion 136 extending between the first end 132 and the second end 134. Although the first and second ends 132 and 134 are depicted as being fixedly secured to the first adjustment mechanism, aspects herein contemplate that each of the first and second ends 132 and 134 may be fixedly secured to, for example, the underband 128 of the support garment 100. In example aspects, the intervening portion 136 repeatedly extends (i.e., loops back-and-forth) between the first adjustment mechanism 124 and a respective pulley structure 126 to form a first plurality of spaced-apart cable segments 138. The cable segments 138 slidably engage with both the first adjustment mechanism 124 and the pulley structures 126. In some examples, a cable segment 138 can include a portion of the cable structure 130 that extends from a first point, which is slidably anchored to the adjustment mechanism 124, to a second point that is slidably anchored to a pulley structure 126.

Each of the cable segments 138 has a length as measured between a bottom edge of the first adjustment mechanism 124 and its corresponding pulley structure 126. In example aspects, the length may range from about 5 cm to about 20 cm. The length of a particular cable segment may be dependent upon various factors, such as one or more of a cup size, overall size of the support garment (e.g., extra small to extra, extra large) and the shape or morphology of a wearer's breast when the support garment 100 is worn. For example, as explained above, when supporting a more globular morphology, central segments can include a longer length, as compared with medial or lateral segments, whereas cables supporting a breast having a flatter morphology may include a more consistent length (among the plurality of cables). Although eight cable segments are depicted in FIG. 1, it is contemplated herein that the first breast-supporting structure 110 may include more than eight cable segments or less than eight cable segments. For example, the first breast-supporting structure 110 may include from about 4 cable segments to about 30 cable segments, from about 6 cable segments to about 24 cable segments, from about 8 cable segments to about 18 cable segments, or from about 10 cable segments to about 12 cable segments. In example aspects, a total length of the cable structure 130 may be generally approximated by multiplying the number of cable segments by a length of each cable segments. Thus, in example aspects, the total length of the cable structure 130 may be from about 15 cm to about 600 cm, from about 30 cm to about 400 cm, or from about 60 cm to about 200 cm.

In example aspects, the first plurality of cable segments 138 include a central set of cable segments 140 configured to extend over a central part of the wearer's breast, a medial set of cable segments 142 configured to extend over a medial part of the wearer's breast, and a lateral set of cable segments 144 configured to extend over a lateral part of the wearer's breast. As described in further detail with respects to FIGS. 3-5, because the cable segments 138 slidably engage with both the first adjustment mechanism 124 and the pulley structures 126, the cable segments 138 provide adjustable support and adjustable fit for the wearer's breast.

Figure 2:
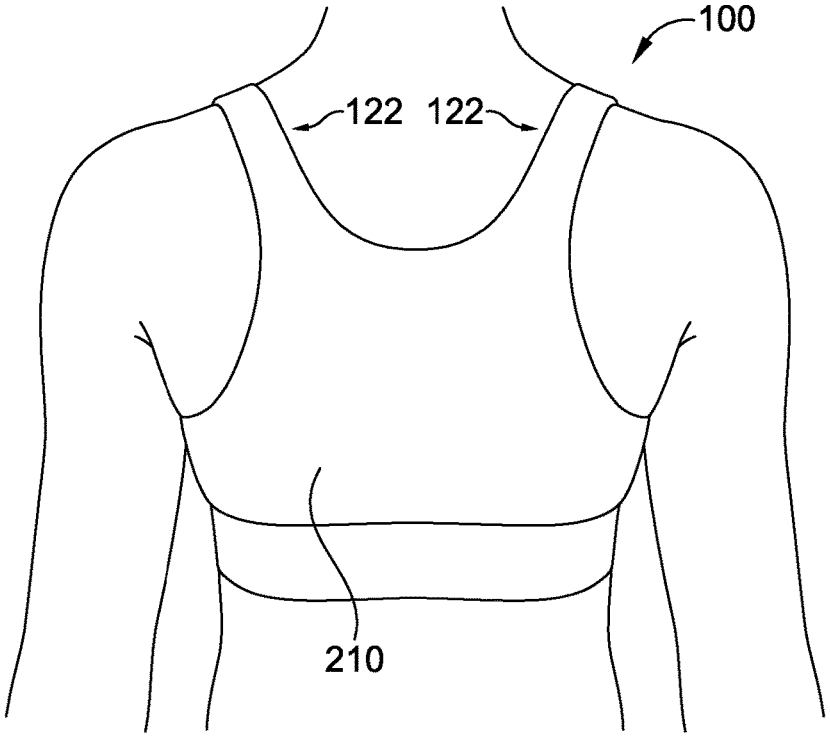
FIG. 2 illustrates a back view of the support garment of FIG. 1 in accordance with aspects herein.

FIG. 2 depicts a back view of the support garment 100. The support garment 100 further includes a back portion 210 where the back portion 210 is connected to the front portion 111 at least by the shoulder straps 122. Although the back portion 210 is depicted as a band-like structure, it is contemplated herein that the back portion 210 may have other configurations such as racerback. It is also contemplated herein that the back portion 210 may have a closure mechanism.

Figure 4:
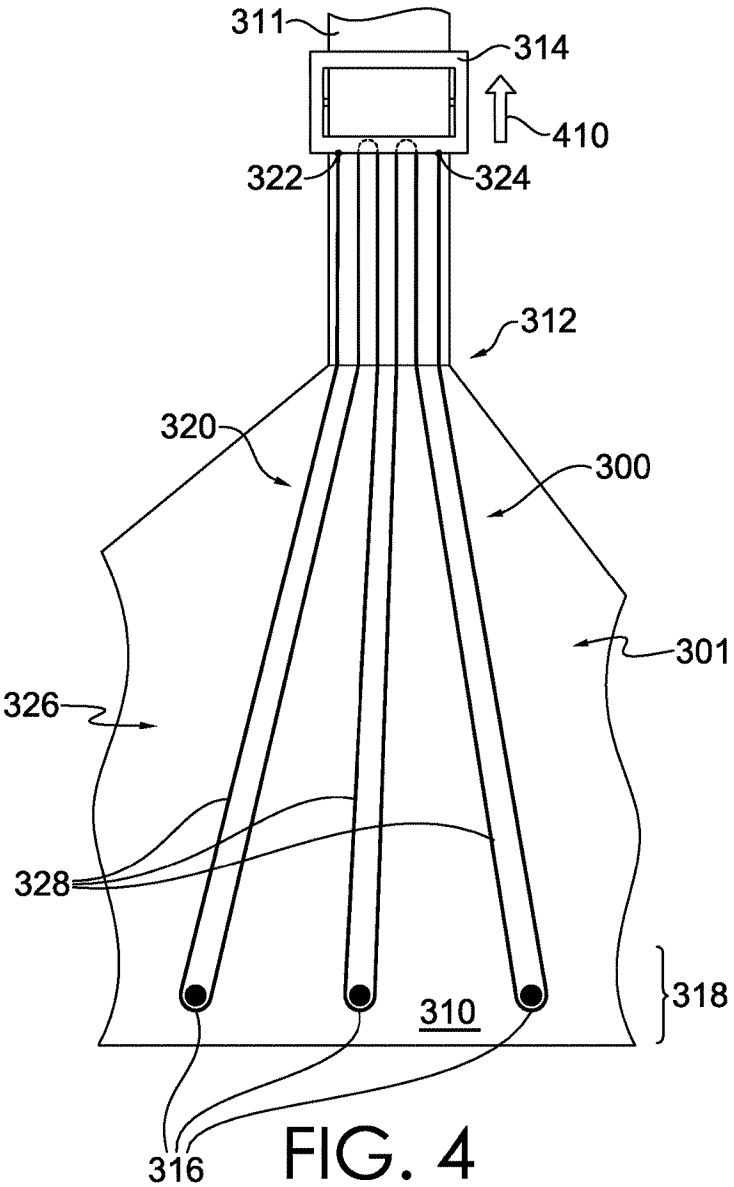
FIG. 4 illustrates the breast-supporting structure of FIG. 3 with a second level of tension in accordance with aspects herein.
Figure 3:
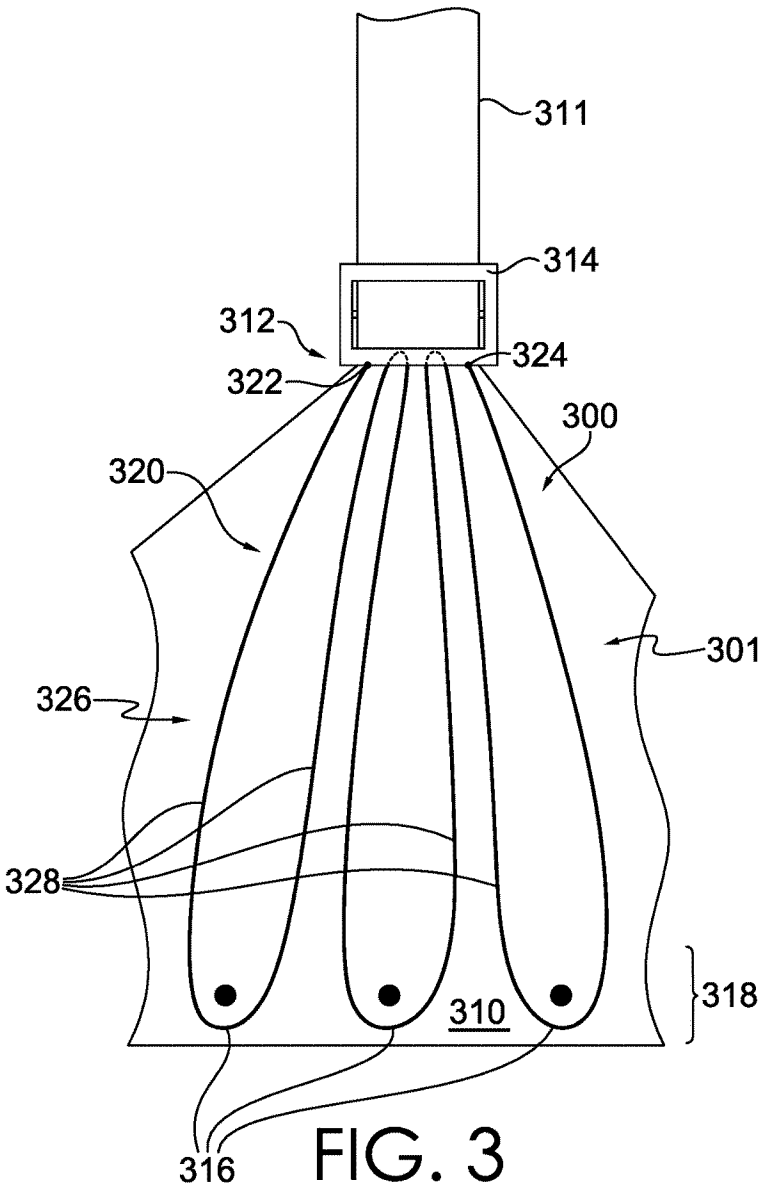
FIG. 3 illustrates an example breast-supporting structure with a first level of tension in accordance with aspects herein.

FIGS. 3 and 4 depict one example way of adjusting the level of support provided by the breast-supporting structure described herein. FIGS. 3-4 depict a breast-supporting structure 300 positioned overtop a portion of a base layer 310 that forms a breast-covering portion 301 of a support garment such as the support garment 100. A shoulder strap 311 is shown extending from an apex portion 312 of the breast-covering portion 301. An adjustment mechanism 314 is slidably coupled to the shoulder strap 311, and a plurality of spaced-apart pulley structures 316 are positioned at an underband area 318 of the breast-covering portion 301. A continuous cable structure 320 is depicted, where the cable structure 320 includes a first end 322 and a second end 324 each of which are fixedly secured to the adjustment mechanism 314. An intervening portion 326 of the cable structure 320 loops back-and-forth between the adjustment mechanism 314 and a respective pulley structure 316 to form a plurality of cable segments 328. The cable segments 328 formed by the intervening portion 326 of the cable structure 320 slidably engage with both the adjustment mechanism 314 and the pulley structures 316. In FIG. 3, the cable segments 328 are depicted having a first level of tension as indicated by their relatively slack state. A wearer might desire to adjust the level of support depending on an activity level. In some instances, more support may be desired when the wearer is engaging in higher or more dynamic activity levels, and as such, the adjustment mechanism 314 can be slid along the shoulder strap 311 and away from the apex portion 312. In some instances, less support may be desired, such as when the wearer is engaging in lower levels of activity, and as such, the adjustment mechanism 314 can be slid along the shoulder strap 311 and toward the apex portion 312.

FIG. 4 depicts the adjustment mechanism 314 being slid upward in the direction of arrow 410 along the length of the shoulder strap 311 or away from the apex portion 312 of the breast-covering portion 301. Because the cable segments 328 slidably engage with the adjustment mechanism 314 and the pulley structures 316, movement of the adjustment mechanism 314 in an upward direction causes the cable segments 328 to transition to a second level of tension, which is greater than the first level of tension, or a relatively taut state as shown in FIG. 4. The transition of the cable segments 328 to the second level of tension increases the support provided by the breast-supporting structure 300 to the wearer's breast. Various cable related changes can occur when the cable segments 328 transition between tension levels. For example, when transitioning to higher tension, a diameter, cross-section profile, cross-section area, or other cross-sectional quality can change (e.g., diameter can decrease, cross-section area can decrease, cross-section profile can change, etc.). On the other hand, when transitioning to lower tension, the cable segment diameter and/or cross-section area can increase. In addition, the overall cable network shape can also change when the cable segments 328 transition between tension levels. For example, in a more relaxed state (e.g., FIG. 3) with less tension, the overall shape of the network of cables can be shorter and/or wider. In addition, one or more of the segments can curve from one attachment point (e.g., near the adjustment mechanism 314) to the opposing attachment point (e.g., a respective pulley). In contrast, in a higher-tension configuration (e.g., FIG. 4), the overall shape of the network of cables can be taller and/or narrower. In addition, one or more of the segments can be relatively straight (e.g., as compared to a more relaxed state) from one attachment point (e.g., near the adjustment mechanism 314) to the opposing attachment point (e.g., a respective pulley). Positioning of the adjustment mechanism 314 along the length of the shoulder strap 311 may be selected by the wearer to produce a desired level of support. Because each of the cable segments 328 is freely movable, the tension generated by movement of the adjustment mechanism 314 is equally distributed across each of the cable segments 328 such that each of the cable segments 328 has substantially the same level of tension. That is, when the adjustment mechanism 314 is moved in the direction of arrow 410, based in part on the cable segments 328 being freely moveable, the overall tension provided by the cable segments 328 can increase (e.g., to provide increased support), and the cable system operates to equalize the tension among the cables (e.g., the tension associated with each cable can also increase and be relatively consistent with the tension of other cables).

Figure 5:
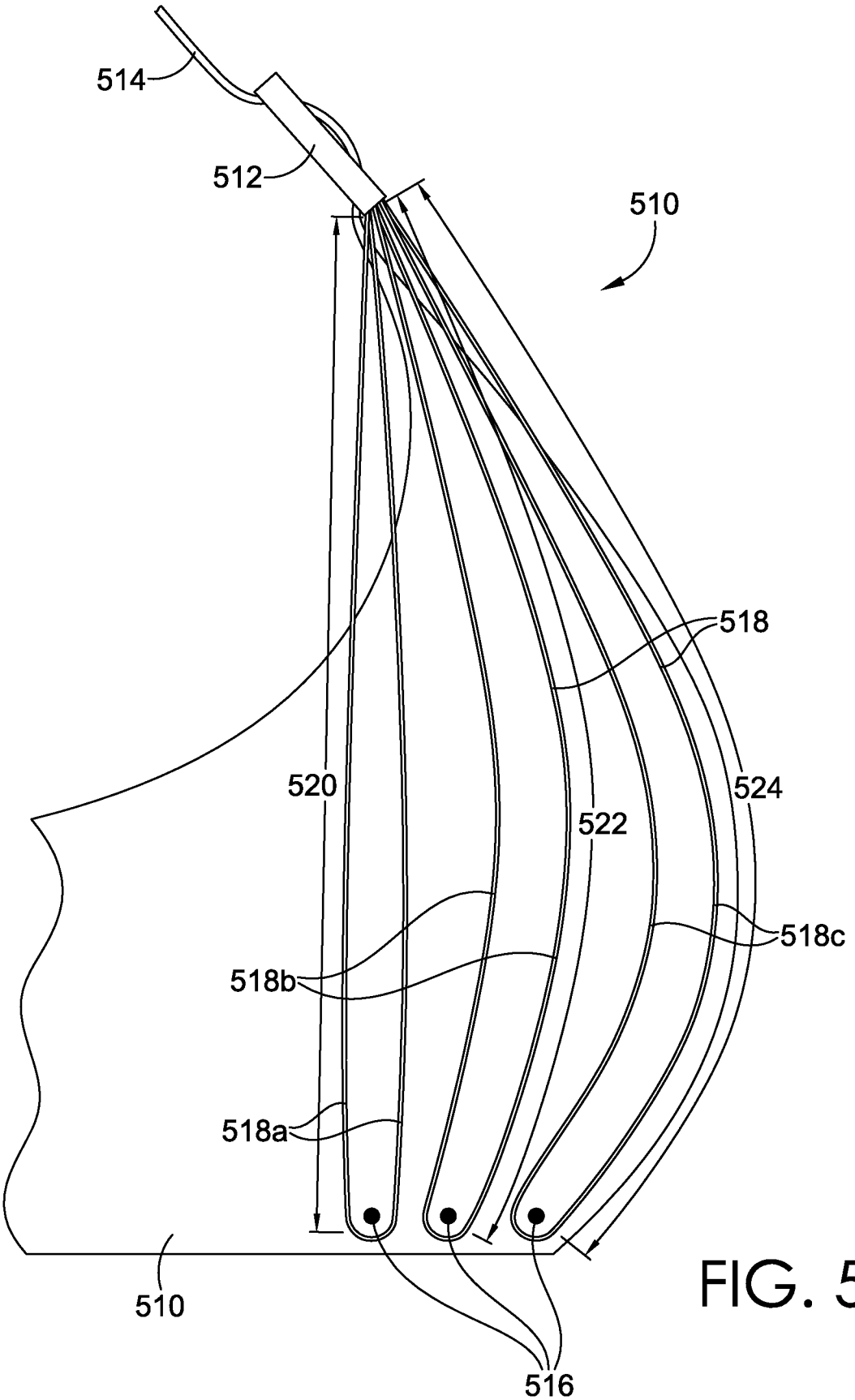
FIG. 5 illustrates a side view of an example breast-supporting structure in accordance with aspects herein.

FIG. 5 depicts how the breast-supporting structure described herein can provide adjustable fit and adjustable support without, for example, movement of the adjustment mechanism along the shoulder strap length. In this example, the displacement caused by different portions of the wearer's breast causes the cable segments to self-adjust in length such that each cable segment has generally the same level of tension to provide a consistent level of support and customized fit to the wearer's breast. FIG. 5 depicts a side view of a schematic of a wearer's breast with a breast-supporting structure 510 positioned overtop the wearer's breast. The breast depicted in FIG. 5 has a generally globular morphology where the central part of the wearer's breast has more volume than the medial and lateral sides of the wearer's breast. The breast-supporting structure 510 includes an adjustment mechanism 512 slidably coupled to a shoulder strap 514 and a plurality of pulley structures 516. A plurality of cable segments 518, including cable segments 518*a*, 518*b*, and 518*c*, are shown extending between the adjustment mechanism 512 and the pulley structures 516 where the cable segments 518 slidably engage with both the adjustment mechanism 512 and the pulley structures 516 as described above.

The cable segments 518*a* are generally positioned at a medial-most aspect of the wearer's breast which has less volume than other portions of the wearer's breast. The cable segments 518*c* are positioned over the central region of the wearer's breast which has more volume than, for example, the medial-most aspect. The cable segments 518*b* are positioned between the cable segments 518*a* and 518*c* in an area that includes a volume of breast tissue intermediate between the medial-most aspect and the central region. Because the cable segments 518 are able to self-adjust in length, the cable segments 518*c* adjust to a longer length 524 due to the increased breast volume in the central region of the breast. A length 522 of the cable segments 518*b* is intermediate between the length 524 of the cable segments 518*c* and a length 520 of the cable segments 518*a*. As shown, the cable segments 518 adjust to provide a customized fit specific to a wearer's breast morphology. Additionally, the level of tension associated with each of the segments 518*a*, 518*b*, and 518*c* is generally the same to provide a consistent level of support across the wearer's breast.

Although FIG. 5 depicts a breast that is not in motion, the self-adjusting feature of the cable segments described herein enables the cable segments to respond to changes in breast morphology due to, for example, motion during exercise. In one example, when a wearer lays on her side, breast tissue may temporarily displace to the side of the breast closest to the ground. In this example, cable segments in this area may self-adjust to increase in length to accommodate the increased breast tissue (e.g., these cable segments can include a longer length relative to other cable segments of the cable structure) and cable segments located on the side of the breast farthest from the ground may decrease in length to accommodate the decreased breast tissue in that area (e.g., these cable segments can include a shorter length relative to other cable segments along the cable structure). In this example, the overall tension of the cable system and the tension associated with each cable segment may stay consistent, and the lengths of the cable segments may adjust to provide responsive support. Because the cable segments generally each have the same amount of tension, the cable segments provide customized fit and uniform support to the wearer's breasts even when the breasts are not in "conventional" positions. As used herein, a conventional position of a breast can include the natural, at-rest position when the wearer is standing on a flat, horizontal surface with their feet flat on the ground. The conventional position can be relative to a parasagittal plane, such that a breast is not in the conventional position when the breast adjusts to a position away from the parasagittal plane.

FIG. 6 depicts one example adjustment mechanism 600 for use as described herein. The adjustment mechanism 600 is in the general form of a slide buckle and is slidably coupled to a strap 610 which may be a shoulder strap as described herein. The adjustment mechanism 600 includes a first face 612, an opposite second face 614, a third face 616, and an opposite fourth face 618. The second face 614 is located on the side of the adjustment mechanism to which the strap 610 is slidably coupled. The first face 612 of the adjustment mechanism 600 includes a plurality of holes 620.

A continuous cable structure 622 is depicted. The continuous cable structure 622 includes a first end 624 fixedly secured to the adjustment mechanism 600 adjacent the fourth face 618 and a second end 626 fixedly secured to the adjustment mechanism 600 adjacent the third face 616. In example aspects, the first and second ends 624 and 626 may be fixedly secured by crimping, melting, adhesives, stitching, bonding, welding, and the like. The continuous cable structure 622 also includes an intervening portion 628 that repeatedly enters and exits respective holes in the plurality of holes 620 to form a plurality of cable segments as described above. Because the cable structure 622 is formed from a material having a low coefficient of friction, the intervening portion 628 is able to slide freely with respect to the plurality of holes 620 allowing the cable segments to adjust in length in response to displacement by breast tissue. The depiction of the adjustment mechanism 600 is illustrative, and it is contemplated herein that other types of adjustment mechanism may be used in accordance with aspects herein.

In at least one example, the adjustment mechanism can include surfaces that are positioned where the cable structure 622 turns (or is slidably anchored) and that are configured to reduce friction with respect to the cable structure 622. For example, referring to FIG. 6B, an adjustment mechanism 600*b* is depicted, and the adjustment mechanism includes 600*b* one or more pulleys 613 around which the cable structure 622 can pass when engaged with the adjustment mechanism 600*b*. The pulley(s) 613 can include a wheel-type structure or other rotatable body that rotates or spins on an axis to ease (e.g., reduce friction associated with) motion of the cable structure 622. In other examples, the pulley(s) 613 can include an arcuate surface that may or may not rotate, and in some examples, the arcuate surface can include a groove in which the cable structure 622 can nest. For example, the pulley(s) 613 can include a U-shaped channel affixed to, or molded with, the adjustment mechanism 600*b*. In some examples, the arcuate surface can be integral with (e.g., molded as part of) the adjustment mechanism 600*b*.

In some examples, the adjustment mechanism 600*b* can include, as compared with the lower portion (e.g., 118 or 128), more pulleys, fewer pulleys, or the same number of pulleys. For example, if both ends of the cable structure 622 are fixed to the adjustment mechanism, then the adjustment mechanism 600*b* can include fewer pulleys than the lower portion If, in an alternative example, both ends of the cable structure are fixed to the lower portion, then the adjustment mechanism 600*b* can include more pulleys than the lower portion. Further, one end of the cable structure can be attached to the adjustment mechanism, and one end of the cable structure can be attached to the lower portion, such that the adjustment mechanism and the lower portion include the same number of pulleys.

In examples, the pulleys associated with the adjustment mechanism can include various spacing (relative to each other), and the pulleys associated with the lower portion can include various spacing (relative to each other). For example, pulleys 613 can include a relatively fixed spacing among one another. The spacing between pulleys 613 can, in some examples be larger than the spacing between pulleys at the lower portion, such that the cable network as a whole tends to flare from a narrower dimensionality near the adjustment mechanism to a wider dimensionality near the lower portion. In some examples, the spacing between the pulleys (e.g., 126) associated with the lower portion can be dynamic and can change based on an amount of tension balanced among the system. For example, in some instances, when the adjustment mechanism is moved in the direction of the arrow 410 (FIG. 4), the pulleys associated with the lower portion may be drawn closer together, such that the spacing between the pulleys is reduced and can be closer to the spacing between the pulleys 613 associated with the adjustment mechanism.

The adjustment mechanisms 600 and 600*b* can include various constructions. For example, adjustment mechanisms 600 and 600*b* can include a monolithic, one-piece construction (e.g., molded), such that the cable structure 622 can be threaded through the holes 620 to attach the cable structure 622 to the adjustment mechanism 600. In some examples, the adjustment mechanisms 600 and 600*b* can include a multi-piece construction, such as including a first part (e.g., front away from the wearer) arranged on one side of the pulleys and a second part (e.g., back towards the wearer) arranged on the opposing side of the pulleys. In some instances, the first part can be removed from the second part to provide access to the pulleys, such as for extending the cable structure around the adjustment mechanism (e.g., around the pulleys of the adjustment mechanism). In some examples, the adjustment mechanism can include, for each of the holes 620, an access slot or groove that is in an outer wall of the adjustment mechanism and that extends the length of the hole 620 to allow the cable to be positioned in the hole.

Figure 7:
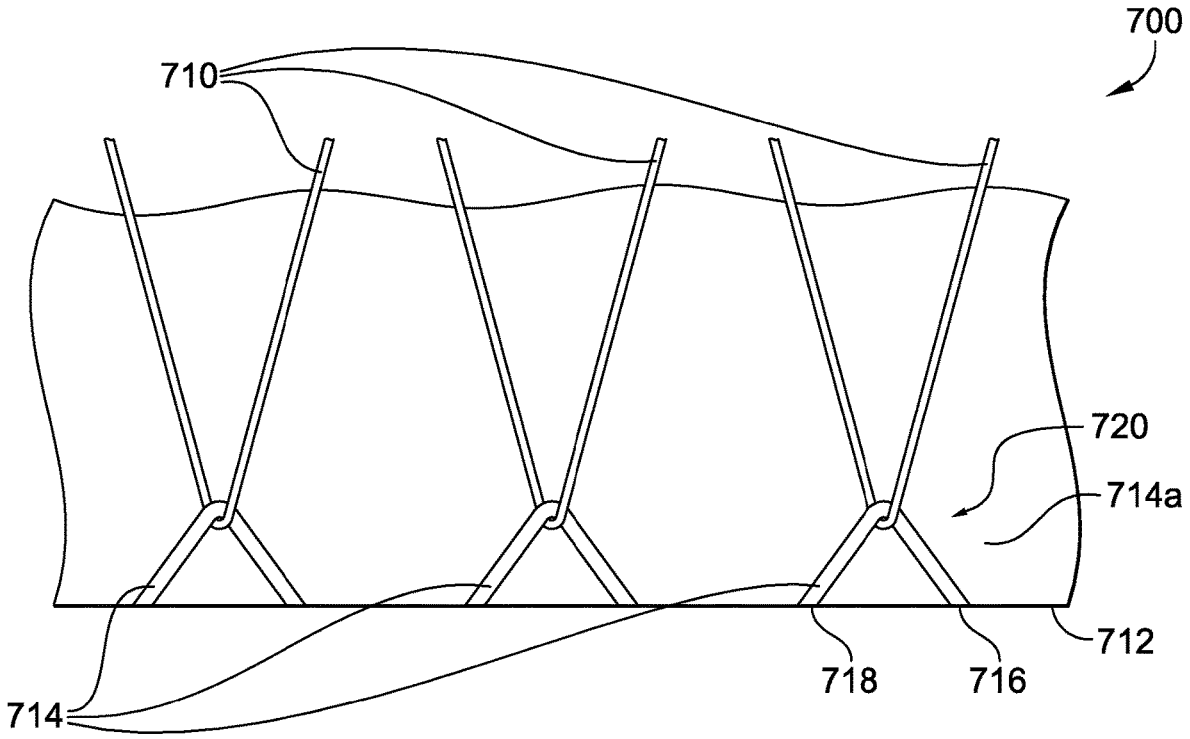
FIG. 7 illustrates first example pulley structures in accordance with aspects herein.
Figure 8:
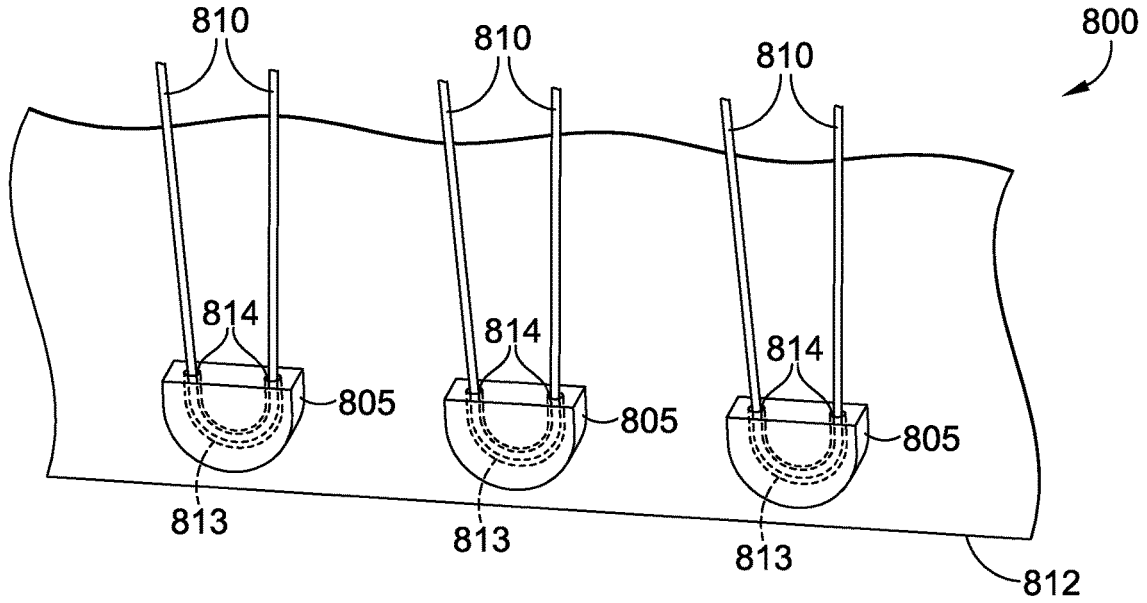
FIG. 8 illustrates second example pulley structures in accordance with aspects herein.

In accordance with some examples, FIGS. 7 and 8 depict two example pulley structures. FIG. 7 depicts a lower portion of a support garment 700. A plurality of cable segments 710 formed from a continuous cable structure are depicted extending toward a lower margin 712 of the support garment 700. A plurality of loops 714 are shown extending upward from the lower margin 712. With respect to, for example, loop 714*a*, the loop 714*a* includes a first end 716 and a second end 718 each of which are fixedly secured to, or adjacent to, the lower margin 712 of the support garment 700. A loop portion 720 of the loop 714*a* is not secured to the support garment 700. Each of the cable segments 710 slidably engage with a respective loop 714 by threading through the respective loop 714. In example aspects, like the continuous cable structure, the loops 714 may be formed from a material that has a low coefficient of friction. Further similar to the continuous cable structure, the material used to form the loops 714 may include a no- or low-stretch material such that the loops 714 do not stretch when tension is place on them by the cable segments 710. One example material includes a yarn formed from para-aramid fibers that is coated with a thermoplastic polyurethane material.

FIG. 8 depicts another example of pulley structures 805 positioned on a support garment 800 adjacent a lower margin 812 of the support garment 800. The pulley structures 805 include a U-shaped channel 813 through which a portion of a continuous cable structure 810 extends by way of holes 814 in the respective pulley structure 805. The pulley structures shown in FIGS. 7 and 8 are illustrative, and it is contemplated herein that other structures that change the direction of a force applied to a continuous cable structure are within the scope herein. Any one or more of the pulley structures illustrated in (or described in association with) FIGS. 6B, 7, and 8 can be associated with the adjustment mechanism and/or the lower portion, lower margin, or underband of the support garment.

Figure 9:
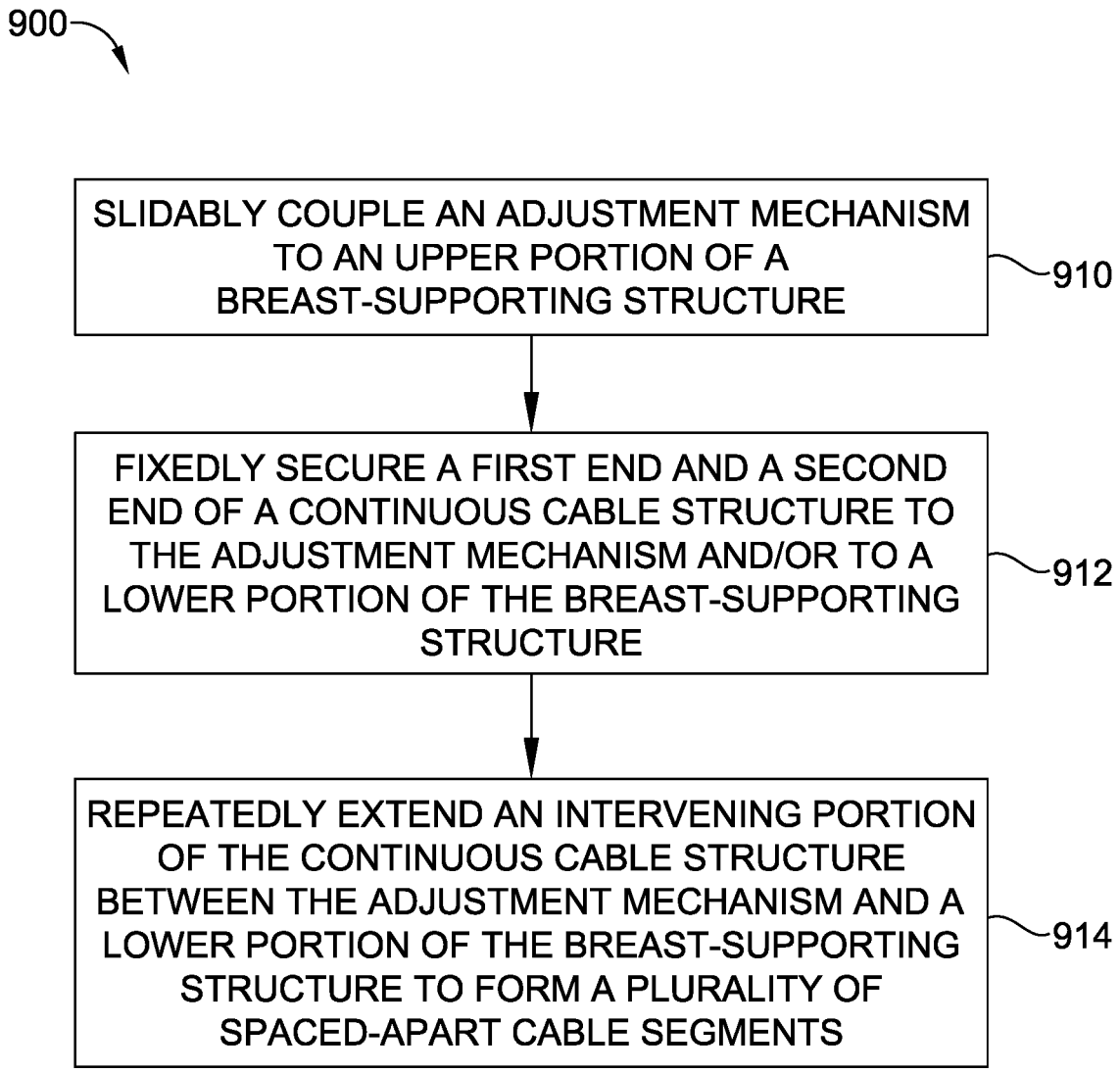
FIG. 9 illustrates a flow diagram of an example method of manufacturing a breast-supporting structure in accordance with aspects herein.

FIG. 9 depicts a flow diagram of an example method 900 of manufacturing a breast-supporting structure such as the breast-supporting structures 110 and 112 of FIG. 1. At a step 910, an adjustment mechanism, such as the adjustment mechanism 124, is slidably coupled to an upper portion of a breast-supporting structure such as a shoulder strap. At a step 912, a first end and a second end of a continuous cable structure such as the continuous cable structure 130 are fixedly secured to the adjustment mechanism. At a step 914, an intervening portion, such as the intervening portion 136, of the continuous cable structure is repeatedly extended between the adjustment mechanism and a lower portion of the breast-supporting structure to form a plurality of spaced-apart cable segments such as the cable segments 138. In example aspects, the cable structure is repeatedly extended between one or more pulleys (or some other arcuate surface or curved channel) associated with the adjustment mechanism and a respective pulley structure located at the lower portion of the breast-supporting structure such as the pulley structures 126. In some examples, the first end and the second end of the continuous cable structure may be fixedly secured to the adjustment mechanism before repeatedly extending the cable back and forth between the adjustment mechanism and the lower portion of the breast-supporting structure. In some examples, the first end and the second end of the continuous cable structure may be fixedly secured to the adjustment mechanism after repeatedly extending the cable back and forth between the adjustment mechanism and the lower portion of the breast-supporting structure. In some examples, the first end of the continuous cable structure may be fixedly secured to the adjustment mechanism before repeatedly extending the cable back and forth between the adjustment mechanism and the lower portion of the breast-supporting structure, and the second end of the continuous cable structure may be fixedly secured to the adjustment mechanism after repeatedly extending the cable back and forth between the adjustment mechanism and the lower portion of the breast-supporting structure.

The method 900 may additionally include incorporating the breast-supporting structure into a support garment such as the support garment 100. In example aspects, this may be done by positioning the breast-supporting structure overtop a base layer such as the base layer 114 that forms the support garment.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

What is claimed is:

1. A breast-supporting structure comprising:

an upper portion and a lower portion that is spaced apart from the upper portion;

an adjustment mechanism slidably coupled to the upper portion; and a continuous cable structure having a first end, a second end, and an intervening portion extending between the first end and the second end, each of the first end and the second end fixedly secured to the adjustment mechanism or the lower portion, wherein the intervening portion repeatedly extends between the adjustment mechanism and the lower portion to form a plurality of spaced-apart cable segments, wherein one or more of the adjustment mechanisms and the lower portion includes a plurality of spaced-apart pulley structures, wherein the intervening portion of the continuous cable structure slidably engages with each of the plurality of spaced-apart pulley structures, and wherein movement of the adjustment mechanism causes at least a portion of the plurality of cable segments to slidably adjust from a first level of tension to a second level of tension.

2. The breast-supporting structure of claim 1, wherein the plurality of cable segments include a central set of cable segments configured to extend over at least a central region of a wearer's breast.

3. The breast-supporting structure of claim 1, wherein the plurality of cable segments include a medial set of cable segments configured to extend over a medial region of a wearer's breast and a lateral set of cable segments configured to extend over a lateral region of the wearer's breast.

4. The breast-supporting structure of claim 1, wherein the continuous cable structure comprises a low stretch or no-stretch material.

5. The breast-supporting structure of claim 1, wherein the intervening portion of the continuous cable structure slidably engages with the adjustment mechanism.

6. A support garment comprising:

a front portion formed from a first breast-supporting structure and a second breast-supporting structure;

a back portion;

a first shoulder strap extending between the first breast-supporting structure and the back portion, the first shoulder strap including a first adjustment mechanism that is slidably coupled to the first shoulder strap;

an underband comprising a lower margin of the front portion;

a first continuous cable structure having a first end, a second end, and an intervening portion extending between the first end and the second end, each of the first end and the second end fixedly secured to the first adjustment mechanism or the underband, wherein the intervening portion repeatedly extends between the first adjustment mechanism and the underband to form a first plurality of cable segments, and wherein one or more of the first adjustment mechanism and the underband includes a plurality of spaced-apart pulley structures.

7. The support garment of claim 6 further comprising:

a second shoulder strap extending between the second breast-supporting structure and the back portion, the second shoulder strap including a second adjustment mechanism that is slidably coupled to the second shoulder strap; and a second continuous cable structure having a first end, a second end, and an intervening portion extending between the first end and the second end, each of the first end and the second end fixedly secured to the second adjustment mechanism or the underband, wherein the intervening portion repeatedly extends between the second adjustment mechanism and the underband to form a second plurality of spaced-apart cable segments.

8. The support garment of claim 7, wherein:

movement of the first adjustment mechanism causes at least a portion of the first plurality of cable segments to slidably adjust from a first level of tension to a second level of tension; and movement of the second adjustment mechanism causes at least a portion of the second plurality of cable segments to slidably adjust from a third level of tension to a fourth level of tension.

9. The support garment of claim 6, wherein a first set of cable segments of the first plurality of cable segments has a different length than a second set of cable segments of the first plurality of cable segments.

10. The support garment of claim 6, wherein a total length of the first continuous cable structure is dependent upon a cup size of the first breast-supporting structure.

11. The support garment of claim 6, wherein the first continuous cable structure comprises a low stretch or no-stretch material.

12. The support garment of claim 6, wherein the intervening portion of the first continuous cable structure slidably engages with at least a portion of the plurality of spaced-apart pulley structures.

13. The support garment of claim 6, wherein the intervening portion of the first continuous cable structure slidably engages with the first adjustment mechanism.

14. A method of manufacturing a breast-supporting structure, the method comprising:

slidably coupling an adjustment mechanism to an upper portion of the breast-supporting structure;

fixedly securing a first end and a second end of a continuous cable structure to the adjustment mechanism or to a lower portion of the breast-supporting structure; and repeatedly extending an intervening portion of the continuous cable structure between the adjustment mechanism and the lower portion of the breast-supporting structure to form a plurality of spaced-apart cable segments.

15. The method of manufacturing the breast-supporting structure of claim 14, further comprising incorporating the breast-supporting structure into a support garment.

16. The method of manufacturing the breast-supporting structure of claim 15, wherein the support garment is a bra.

17. The method of manufacturing the breast-supporting structure of claim 16, wherein the lower portion of the breast-supporting structure is an underband configured to encircle a torso area of a wearer.

* * * * *